US006945468B1

(12) United States Patent
Rodriguez et al.

(10) Patent No.: US 6,945,468 B1
(45) Date of Patent: Sep. 20, 2005

(54) RAINFALL SIMULATION APPARATUS

(76) Inventors: Cipriano Rodriguez, 60 S. 21st St., Wyandanch, NY (US) 11798; Erika Rodriguez, 60 S. 21st St., Wyandanch, NY (US) 11798

( * ) Notice: Subject to any disclaimer, the term of this patent is extended or adjusted under 35 U.S.C. 154(b) by 137 days.

(21) Appl. No.: 10/369,476

(22) Filed: Feb. 20, 2003

(51) Int. Cl.[7] ..... B05B 17/08; B05B 15/06; B05B 1/00; A62C 35/00

(52) U.S. Cl. ..... 239/17; 239/22; 239/23; 239/208; 239/209; 239/211; 169/13; 169/16

(58) Field of Search ..... 239/17, 22, 23, 239/208, 209, 289, 193, 211, 200; 169/16, 169/13; 52/302.1, 302.5, 12, 13, 14; 47/17

(56) References Cited

U.S. PATENT DOCUMENTS 884,208 A * 4/1908 Rice ..... 52/14
1,936,732 A * 11/1933 Renard ..... 52/741.3
3,583,490 A * 6/1971 McFadden ..... 169/60
4,428,434 A * 1/1984 Gelaude ..... 169/13
D302,055 S * 7/1989 Gallagher ..... D30/104
5,000,118 A * 3/1991 Merritt et al. ..... 119/246
5,183,004 A * 2/1993 Trent et al. ..... 119/246
5,542,451 A * 8/1996 Foster ..... 137/625.11
5,775,260 A * 7/1998 Jansen ..... 119/246
5,970,918 A * 10/1999 Bargy ..... 119/246

* cited by examiner

*Primary Examiner*—David A. Scherbel
*Assistant Examiner*—Seth Barney

(57) ABSTRACT

A rainfall simulation apparatus for a structure is provided, comprising a water source, an electric pump, a vertically oriented riser pipe, a perforated header pipe along the roof of the structure, a V-shaped aperture-containing trough connected to the roof, and an elongated collection bin below the trough and connected to the pump. The rainfall simulation apparatus has particular utility in connection with providing the relaxing acoustic effect of rainfall on a structure while additionally providing the visual effect of rainfall through the windows of the structure.

20 Claims, 2 Drawing Sheets

RAINFALL SIMULATION APPARATUS

BACKGROUND OF THE INVENTION

1. Field of the Invention

The present invention relates to a rainfall simulation apparatus for use in connection with an atrium, a sunroom, or other similar structure. The rainfall simulation apparatus has particular utility in connection with providing the relaxing acoustic effect of rainfall on a structure while additionally providing the visual effect of rainfall through the windows of the structure.

2. Description of the Prior Art

A rainfall simulation apparatus is desirable for providing the relaxing acoustic effect of rainfall on a structure while additionally providing the visual effect of rainfall through the windows of the structure.

The use of water distribution systems for aquariums and terrariums is known in the prior art. For example, U.S. Pat. No. 5,000,118 to Merritt et al. discloses an aquatic/terrestrial display unit. However, the Merritt '118 patent does not provide a rainfall effect for an atrium or other type of room.

U.S. Pat. No. 5,542,451 to Foster discloses a water distribution device. However, the Foster '451 patent does not provide a rainfall effect for an atrium or other type of room.

U.S. Pat. No. 5,775,260 to Jansen discloses an aquarium extension. However, the Jansen '260 patent does not provide a rainfall effect for an atrium or other type of room.

U.S. Pat. No. 5,970,918 to Bargy discloses an aquarium-terrarium ecosystem apparatus. However, the Bargy '918 patent does not provide a rainfall effect for an atrium or other type of room.

U.S. Pat. No. 5,183,004 to Trent et al. discloses a self-contained vivarium. However, the Trent '004 patent does not provide a rainfall effect for an atrium or other type of room.

Lastly, U.S. Pat. No. Des. 302,055 to Gallagher discloses a combination aquarium and terrarium. However, the Gallagher '055 patent does not provide a rainfall effect for an atrium or other type of room.

While the above-described devices fulfill their respective, particular objectives and requirements, the aforementioned patents do not describe a rainfall simulation apparatus that provides the relaxing acoustic effect of rainfall on a structure while additionally providing the visual effect of rainfall through the windows of the structure. The prior art patents make no provision for providing a realistic rainfall effect for individuals inside an atrium, sunroom, or other similar structure.

Therefore, a need exists for a new and improved rainfall simulation apparatus that can be used for providing the relaxing acoustic effect of rainfall on a structure while additionally providing the visual effect of rainfall through the windows of the structure. In this regard, the present invention substantially fulfills this need. In this respect, the rainfall simulation apparatus according to the present invention substantially departs from the conventional concepts and designs of the prior art, and in doing so provides an apparatus primarily developed for the purpose of providing the relaxing acoustic effect of rainfall on a structure while additionally providing the visual effect of rainfall through the windows of the structure.

SUMMARY OF THE INVENTION

In view of the foregoing disadvantages inherent in the known types of water distribution systems now present in the prior art, the present invention provides an improved rainfall simulation apparatus, and overcomes the above-mentioned disadvantages and drawbacks of the prior art. As such, the general purpose of the present invention, which will be described subsequently in greater detail, is to provide a new and improved rainfall simulation apparatus and method which has all the advantages of the prior art mentioned heretofore and many novel features that result in a rainfall simulation apparatus which is not anticipated, rendered obvious, suggested, or even implied by the prior art, either alone or in any combination thereof.

To attain this, the present invention essentially comprises a rainfall simulation apparatus, comprising a pump, a riser pipe connected to the pump, a header pipe connected to the riser pipe with the header pipe defining a plurality of perforations therein, a trough below the header pipe with the trough defining a plurality of apertures therein, and at least one elongated collection bin below the trough and connected to the pump.

In one embodiment, the present invention comprises a rainfall simulation apparatus, comprising an electric pump, a vertically oriented riser pipe connected to the pump, a structure next to the riser pipe with the structure comprising a roof connected to substantially vertical walls, a header pipe connected to the riser pipe and along the roof with the header pipe defining a plurality of perforations therein, a V-shaped trough connected to the roof with the trough defining a plurality of apertures therein, and at least one elongated collection bin below the trough and connected to the pump.

In another embodiment, the present invention comprises a rainfall simulation apparatus, comprising a water source, an electric pump connected to the water source, a vertically oriented riser pipe connected to the pump, a structure next to the riser pipe with the structure comprising a roof connected to substantially vertical walls, a header pipe connected to the riser pipe and along the roof with the header pipe defining a plurality of perforations therein, a V-shaped trough connected to the roof with the trough defining a plurality of apertures therein, and at least one elongated collection bin below the trough and connected to the pump, wherein water pumped through the riser pipe and the header pipe exits the perforations and flows down the roof into the trough, drops thorough the apertures into the collection bin, and flows back to the pump.

There has thus been outlined, rather broadly, the more important features of the invention in order that the detailed description thereof that follows may be better understood and in order that the present contribution to the art may be better appreciated.

The invention may also include adjustable water nozzles. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved rainfall simulation apparatus that has all of the advantages of the prior art water distribution systems and none of the disadvantages.

It is another object of the present invention to provide a new and improved rainfall simulation apparatus that may be easily and efficiently manufactured and marketed.

An even further object of the present invention is to provide a new and improved rainfall simulation apparatus that has a low cost of manufacture with regard to both materials and labor, and which accordingly is then susceptible of low prices of sale to the consuming public, thereby making such rainfall simulation apparatus economically available to the buying public.

Still another object of the present invention is to provide a new rainfall simulation apparatus that provides in the apparatuses and methods of the prior art some of the advantages thereof, while simultaneously overcoming some of the disadvantages normally associated therewith.

Even still another object of the present invention is to provide a rainfall simulation apparatus for providing the relaxing acoustic effect of rainfall on a structure. This allows an individual to experience the soothing relaxation and stress-relieving effect provided by the sound of rainfall.

Still yet another object of the present invention is to provide a rainfall simulation apparatus for providing the visual effect of rainfall through the windows of a structure. This makes it possible to make the soothing relaxation and stress-relieving effect of rainfall more realistic for an individual through the sense of sight.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
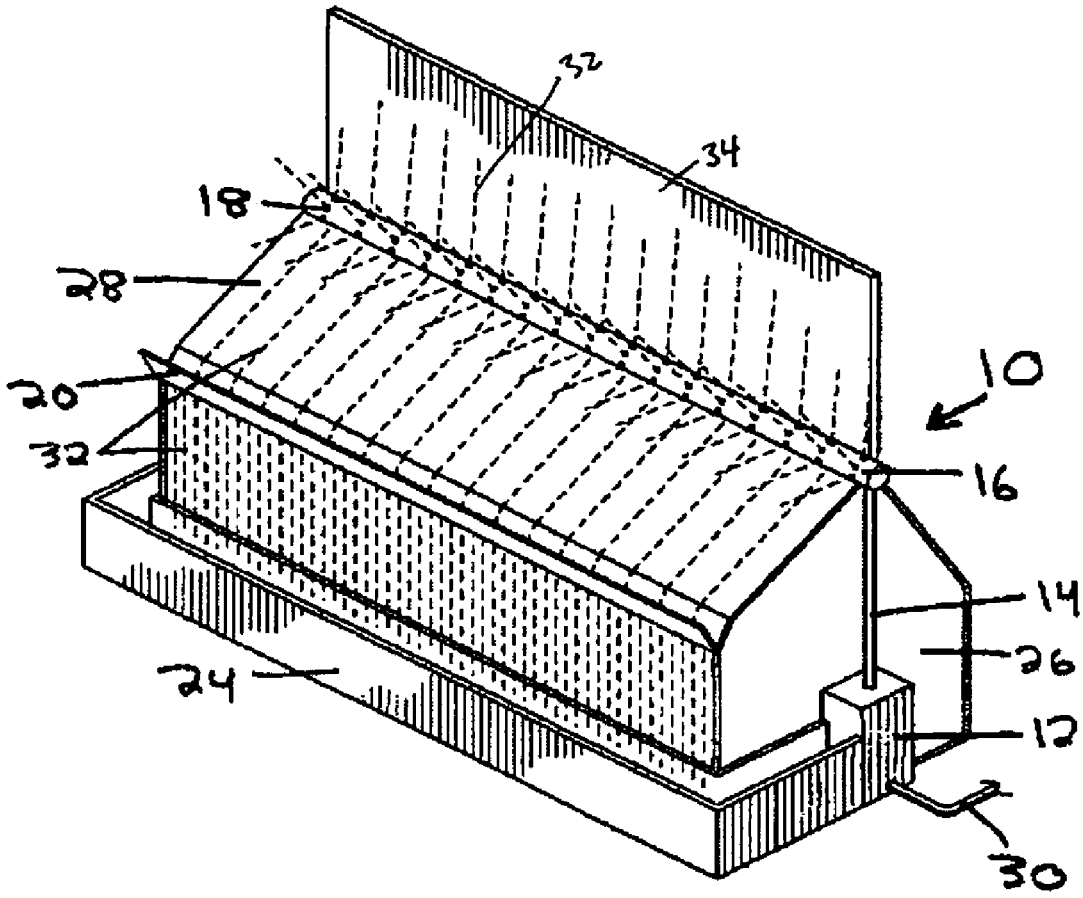
FIG. 1 is an isometric perspective view of the preferred embodiment of the rainfall simulation apparatus constructed in accordance with the principles of the present invention.
Figure 2:
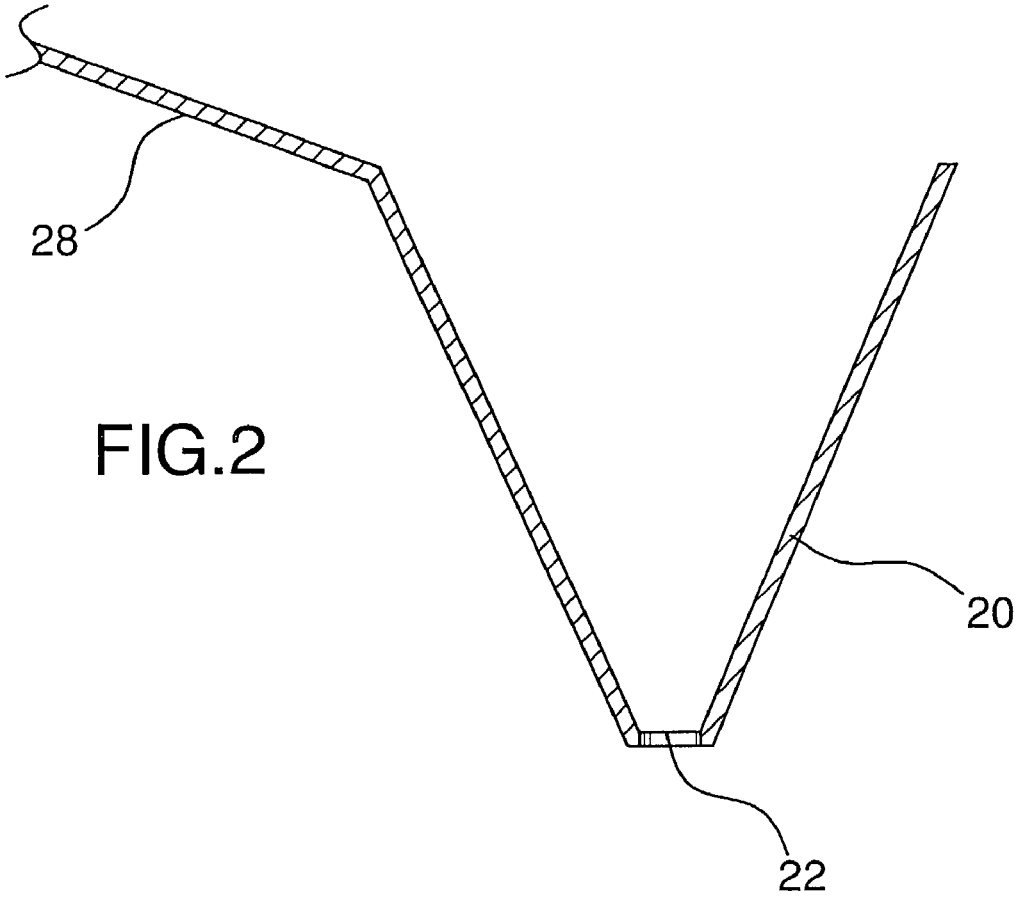
FIG. 2 is an enlarged side elevational cross-sectional view of the trough of the rainfall simulation apparatus of the present invention.
Figure 3:
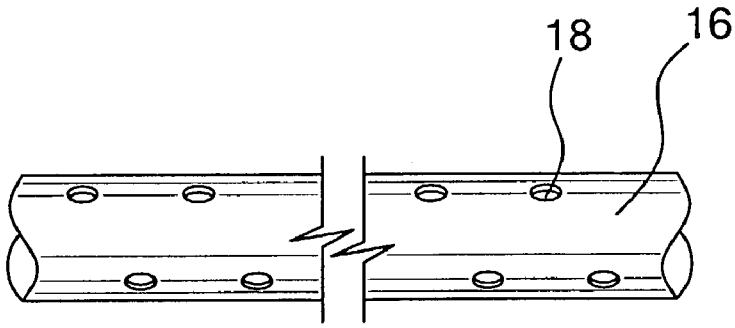
FIG. 3 is an enlarged front elevational view of the header pipe of the rainfall simulation apparatus of the present invention.

Referring now to the drawings, and particularly to FIGS. 1–3, a preferred embodiment of the rainfall simulation apparatus of the present invention is shown and generally designated by the reference numeral 10.

In FIG. 1, a new and improved rainfall simulation apparatus 10 of the present invention for providing the relaxing acoustic effect of rainfall on a structure while additionally providing the visual effect of rainfall through the windows of the structure is illustrated and will be described. More particularly, the rainfall simulation apparatus 10 comprises a water source 30, an electric pump 12 connected to the water source 30, a vertically oriented riser pipe 14 connected to the pump 12, a structure 26 next to the riser pipe 14 with the structure 26 comprising a roof 28 connected to substantially vertical walls, a header pipe 16 connected to the riser pipe 14 and along the roof 28 with the header pipe 16 defining a plurality of perforations 18 therein through which water 32 can flow to simulate rainfall, a V-shaped trough 20 connected to the roof 28 with the trough 20 defining a plurality of apertures therein through which water 32 can flow to simulate rainfall, and at least one elongated collection bin 24 below the trough 20 and connected to the pump 12, wherein water 32 pumped through the riser pipe 14 and the header pipe 16 exits the perforations 18 and flows down the roof 28 into the trough 20, drops thorough the apertures into the collection bin 24, and flows back to the pump 12. A vertically rising structure 34 is attached to the sidewall of the header pipe 16 and prevents water 32 from flowing down the portion of the roof that does not have a trough 20 and collection bin 24 beneath it.

FIG. 2 is an enlarged side elevational cross-sectional view of the trough 20 of the rainfall simulation apparatus of the present invention, and illustrates the trough 20 connected to the roof 28. The bottom of the trough 20 has apertures 22 through which water can flow to simulate rainfall.

FIG. 3 is an enlarged front elevational view of the header pipe 16 of the rainfall simulation apparatus of the present invention, and illustrates the header pipe 16 having perforations 18 through which water can flow to simulate rainfall.

The rainfall simulation apparatus of the present invention is a system that provides a simulated rainfall effect on the exterior of a sunroom, atrium, or related glazed area. In one embodiment, the unit comprises a suitably large electric pump. Its outlet is linked to a riser pipe that extends up one end of the atrium or related structure in question. Its upper end is linked to a header pipe that extends the length of the roof of this structure. Its upper surface features a series of small perforations in order to provide an even, diffuse level of distribution. In a preferred embodiment, these perforations comprise adjustable water nozzles with diameters of about 1/16 inch to about 3/4 inch, with a spacing of about 3 inches to about 6 inches between perforations. The pump is supplied via an outside water source and one or more plastic, elongated, collection bins that are routed along the lower outside perimeter of the structure. They preferably feature an overflow portion to permit excess water to be channeled into a dry well, French drain, etc. In order to provide the requisite rainfall effect outside of the windows of the structure, the usual gutter is replaced with a special trough. This features a V-shaped cross-section, with a flange on one side that permits it to be fastened to the lower edge of the roof of the structure. In one embodiment, small holes extend through the bottom of the trough, and in another embodiment, its lower portion features a series of approximately 2 inch to approximately 4 inch wide apertures, or gaps.

The roof of the structure may comprise steel, galvanized steel, tile, glass, transparent plastic, or any other suitable material. The pipes may comprise steel, copper, plastic such as PVC, or any other suitable material. The trough and collection bins may comprise aluminum, plastic, or other suitable material. If steel is used, it is preferably painted to prevent rusting.

The rainfall simulation apparatus of the present invention fulfills the need for a simulated rainfall effect on the exterior of an atrium, sunroom, or related structure. The appealing features of the rainfall simulation apparatus include its unobtrusive appearance, ease of operation, and the realistic effect it provides. The small size and low profile of the components of this system endow it with a visually unobtrusive appearance when not in use. Operation involves merely turning on the unit's pump. This initiates a rainfall-like effect on the roof of such a structure, thereby producing the familiar, relaxing acoustic signature of this type of event. By channeling the runoff along the length of the structure, the trough portion provides the visual effect of rain through the windows of the structure. The water is then collected in the unit's tanks and is re-circulated, thus continuing the relaxing, stress-reducing rainfall effect.

In one embodiment, the rainfall simulation apparatus of the present invention comprises a waterfall apparatus in operable association with an atrium, wherein the waterfall is formed from an elongated V-shaped trough apparatus having a plurality of offset apertures extending therethrough for creating a unique waterfall arrangement.

In use, it can now be understood that the rainfall simulation apparatus of the present invention has particular utility in connection with providing the relaxing acoustic effect of rainfall on a structure while additionally providing the visual effect of rainfall through the windows of the structure.

While a preferred embodiment of the rainfall simulation apparatus has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as any metal, plastic, or composite material may be used instead of the materials described. Also, the pump may be powered by kerosene, natural gas, or any known type of power rather than electricity. And although providing the relaxing acoustic effect of rainfall on a structure while additionally providing the visual effect of rainfall through the windows of the structure has been described, it should be appreciated that the rainfall simulation apparatus herein described is also suitable for irrigating an atrium or related structure, and simulating the effect of a rainforest. Furthermore, a wide variety of different pipe configurations may be used for structures with different roof shapes instead of those described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A rainfall simulation apparatus, comprising:

a pump;

a riser pipe connected to said pump;

a header pipe having a sidewall connected to said riser pipe, said header pipe defining a plurality of perforations therein;

a trough below said header pipe, said trough defining a plurality of apertures therein;

at least one elongated collection bin below said trough and connected to said pump; and vertically rising structure having sides with one side attached to said sidewall of said header pipe, wherein said vertically rising structure prevents water sprayed from said perforations from flowing away from said collection bin.

2. The rainfall simulation apparatus of claim 1, wherein said pump is powered by electricity.

3. The rainfall simulation apparatus of claim 1, wherein said trough is V-shaped.

4. The rainfall simulation apparatus of claim 1, wherein said perforations comprise adjustable water nozzles.

5. The rainfall simulation apparatus of claim 1, further comprising a structure, said structure comprising a roof connected to substantially vertical walls.

6. The rainfall simulation apparatus of claim 1, further comprising a water source connected to said pump.

7. The rainfall simulation apparatus of claim 1, wherein water pumped through said riser pipe and said header pipe exits said perforations and enters said trough, drops thorough said apertures into said collection bin, and flows back to said pump.

8. The rainfall simulation apparatus of claim 1, wherein said rainfall simulation apparatus provides the acoustic effect of rainfall and the visual effect of rainfall.

9. A rainfall simulation apparatus, comprising:

an electric pump;

a vertically oriented riser pipe connected to said pump;

a structure next to said riser pipe, said structure comprising a roof connected to substantially vertical walls;

a header pipe having a sidewall connected to said riser pipe and along said root said header pipe defining a plurality of perforations therein;

a V-shaped trough connected to said roof, said trough defining a plurality of apertures therein;

at least one elongated collection bin below said trough and connected to said pump; and a vertically rising structure having opposing sides with one side attached to said sidewall of said header pipe, wherein said vertically rising structure prevents water sprayed from said perforations from flowing away from said collection bin.

10. The rainfall simulation apparatus of claim 9, wherein said perforations comprise adjustable water nozzles.

11. The rainfall simulation apparatus of claim 9, wherein said structure comprises an atrium.

12. The rainfall simulation apparatus of claim 9, further comprising a water source connected to said pump.

13. The rainfall simulation apparatus of claim 9, wherein water pumped through said riser pipe and said header pipe exits said perforations and flows down said roof into said trough, drops thorough said apertures into said collection bin, and flows back to said pump.

14. The rainfall simulation apparatus of claim 9, wherein said rainfall simulation apparatus provides the acoustic effect of rainfall and the visual effect of rainfall on said structure.

15. A rainfall simulation apparatus, comprising:

a water source;

an electric pump connected to said water source;

a vertically oriented riser pipe connected to said pump;

a structure next to said riser pipe, said structure comprising a roof connected to substantially vertical walls;

a header pipe connected to said riser pipe and along said roof, said header pipe defining a plurality of perforations therein;

a V-shaped trough connected to said roof, said trough defining a plurality of apertures therein; and at least one elongated collection bin below said trough and connected to said pump;

a vertically rising structure having opposing sides with one side attached to said sidewall of said header pipe, wherein said vertically rising structure prevents water sprayed from said perforations from flowing away from said collection bin;

wherein water pumped through said riser pipe and said header pipe exits said perforations and flows down said roof into said trough, drops thorough said apertures into said collection bin, and flows back to said pump.

16. The rainfall simulation apparatus of claim 15, wherein said perforations comprise adjustable water nozzles.

17. The rainfall simulation apparatus of claim 15, wherein said structure comprises an atrium.

18. The rainfall simulation apparatus of claim 15, wherein said rainfall simulation apparatus provides the acoustic effect of rainfall on said structure.

19. The rainfall simulation apparatus of claim 15, wherein said rainfall simulation apparatus provides the visual effect of rainfall on said structure.

20. The rainfall simulation apparatus of claim 15, wherein water is re-circulated through said apparatus.

* * * * *